US005752281A

United States Patent [19]

Conner

[11] Patent Number: 5,752,281

[45] Date of Patent: May 19, 1998

[54] SHUT-OFF DEVICE FOR THE FLOAT VALVE ASSEMBLY OF A TOILET

[76] Inventor: Bernard J. Conner, 61 Heritage Ct., Annapolis, Md. 21401

[21] Appl. No.: 740,559

[22] Filed: Oct. 30, 1996

[51] Int. Cl.[6] ..... E03D 11/02

[52] U.S. Cl. ..... 4/427; 4/415

[58] Field of Search ..... 4/325, 414, 415, 4/353, 427; 137/410, 434, 429, 441, 400

[56] References Cited

U.S. PATENT DOCUMENTS

| | | | |
|---|---|---|---|
| 2,440,389 | 4/1948 | Anderson, Sr. | 4/427 |
| 4,240,167 | 12/1980 | Gilliland | 4/324 |
| 4,348,778 | 9/1982 | Rau | 4/427 |
| 4,633,534 | 1/1987 | Hardman | 4/412 |
| 4,750,220 | 6/1988 | Baumann | 4/324 |
| 4,864,665 | 9/1989 | Toltzman | 4/325 |
| 5,232,011 | 8/1993 | Royalty | 137/410 |

*Primary Examiner*—David J. Walczak
*Attorney, Agent, or Firm*—Aquilino & Welsh

[57] ABSTRACT

An auxiliary shut-off device for stopping the flow of water into a toilet tank, wherein the toilet tank includes a float valve assembly having a float valve which rises within the toilet tank to control the flow of water into the toilet tank. The assembly includes a lever adapted to be pivotally secured to the toilet tank and a control arm having a proximal end secured to the lever and a distal end adapted to engaging the float valve assembly. The assembly is adapted to be mounted within the toilet tank such that rotation of the lever arm causes the float valve assembly to rotate to a stop position and stop the flow of water into the toilet tank.

20 Claims, 3 Drawing Sheets

SHUT-OFF DEVICE FOR THE FLOAT VALVE ASSEMBLY OF A TOILET

BACKGROUND OF THE INVENTION

1. Field of the Invention

The invention relates to shut-off devices for toilets and, more particularly, to a shut-off device for controlling the opening and closing of a float valve assembly housed within a conventional toilet tank.

2. Description of the Prior Art

The flow of water into and out of a toilet tank is controlled by the movement of a flush lever that actuates a flapper valve seated within a valve seat. The flush lever is linked to the flapper valve by a flush arm. As a result, when the flush lever is rotated counter-clockwise, the flapper valve is moved from the valve seat. This permits water to flow from the tank and into the toilet bowl as the waste water is flushed from within the toilet bowl.

When the water flows from the toilet tank, the float valve drops as it floats upon the surface of the water contained within the toilet tank. Movement of the float valve downwardly actuates the float valve assembly to begin the flow of water into the toilet tank. At the same time, the flapper valve begins to move toward the valve seat and seats in the valve seat when the water level nears the bottom of the tank. After the flapper valve seats in the valve seat, the flow of water from the toilet tank into the toilet bowl is stopped and the water flowing through the float valve assembly begins to fill the toilet tank. As the water level within the toilet tank begins to rise, the float valve floats on the surface of the water within the toilet tank and continues to rise as the water fills the toilet tank. When the float valve reaches its stop position at the top of the toilet tank, the float valve contacts the stop valve of the float valve assembly, stopping the flow of water to toilet tank through the float valve assembly. The toilet is then ready for use.

Despite the simplicity of conventional toilets, the flow of water into or out of the toilet tank does not always occur in the planned manner. For example, the flapper valve may not seat properly in the valve seat. When this occurs the water generally does not fill the toilet tank and the float valve is unable to rise to its stop position so that the flow of water from the float valve assembly is stopped. Even when the level of water in the tank is high enough to permit the float valve to rise to its stop position, water leaking through the flapper valve and valve seat will cause the float valve to slowly move downwardly causing the float valve assembly to intermittently open and fill the toilet tank. Similarly, any leak within the toilet tank will prevent the toilet tank from properly filling and cause the float valve assembly to continually open. In addition, any blockage in the toilet may cause the bowl to continue to fill, permitting raw sewage to overflow the toilet bowl.

In addition to leaks which may cause the float valve assembly to function improperly, the assembly may simply malfunction and not close when the float valve rises to its stop position. When this occurs, the float valve assembly will remain open permitting water to flow within the toilet tank as the excess water exits the toilet tank through the overflow. Many times this problem can be readily fixed by lifting the float valve to cause actuation of the stop valve.

The prior art includes many attempts to permit individuals to control the mechanical parts within the toilet tank such that undesirable malfunctions may be cured without directly handling the internal structure of the toilet tank.

Unfortunately, these prior art devices have been unable to provide a simple remedy meeting the public's need for a simple, convenient and inexpensive device for controlling the function of a toilet tank. The present invention provides a shut-off device for toilet tanks which overcomes the shortcomings of prior devices.

SUMMARY OF THE INVENTION

It is, therefore, an object of the present invention to provide an auxiliary shut-off device for stopping the flow of water into a toilet tank, wherein the toilet tank includes a float valve assembly having a float valve which rises within the toilet tank to control the flow of water into the toilet tank. The assembly includes a lever adapted to be pivotally secured to the toilet tank and a control arm having a proximal end secured to the lever and a distal end adapted to engaging the float valve assembly. The assembly is adapted to be mounted within the toilet tank such that rotation of the lever arm causes the float valve assembly to rotate to a stop position and stop the flow of water into the toilet tank.

It is also an object of the present invention to provide an auxiliary shut-off device further including a latch assembly for supporting the float valve assembly after the lever arm has been rotated to the stop position, wherein the latch assembly includes a camming member which releasably engages a stop.

It is another object of the present invention to provide an auxiliary shut-off device wherein the float valve includes a float and a float arm, and the control arm is adapted to engage the float arm such that rotation of the lever causes the float valve to rotate upwardly to the stop position and stop the flow of water through the float valve assembly.

It is a further object of the present invention to provide an auxiliary shut-off device wherein the float valve assembly includes a stop arm coupled to the float valve such that the stop arm is moved upwardly by the float valve to stop the flow of water through the float valve assembly when the stop arm reaches the stop position, and the control arm is adapted to engage the stop arm such that rotation of the lever causes the stop arm to rotate upwardly to the stop position and stop the flow of water through the float valve assembly.

It is also a further object of the present invention to provide an auxiliary shut-off device wherein the lever is integrally formed with a flush lever.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
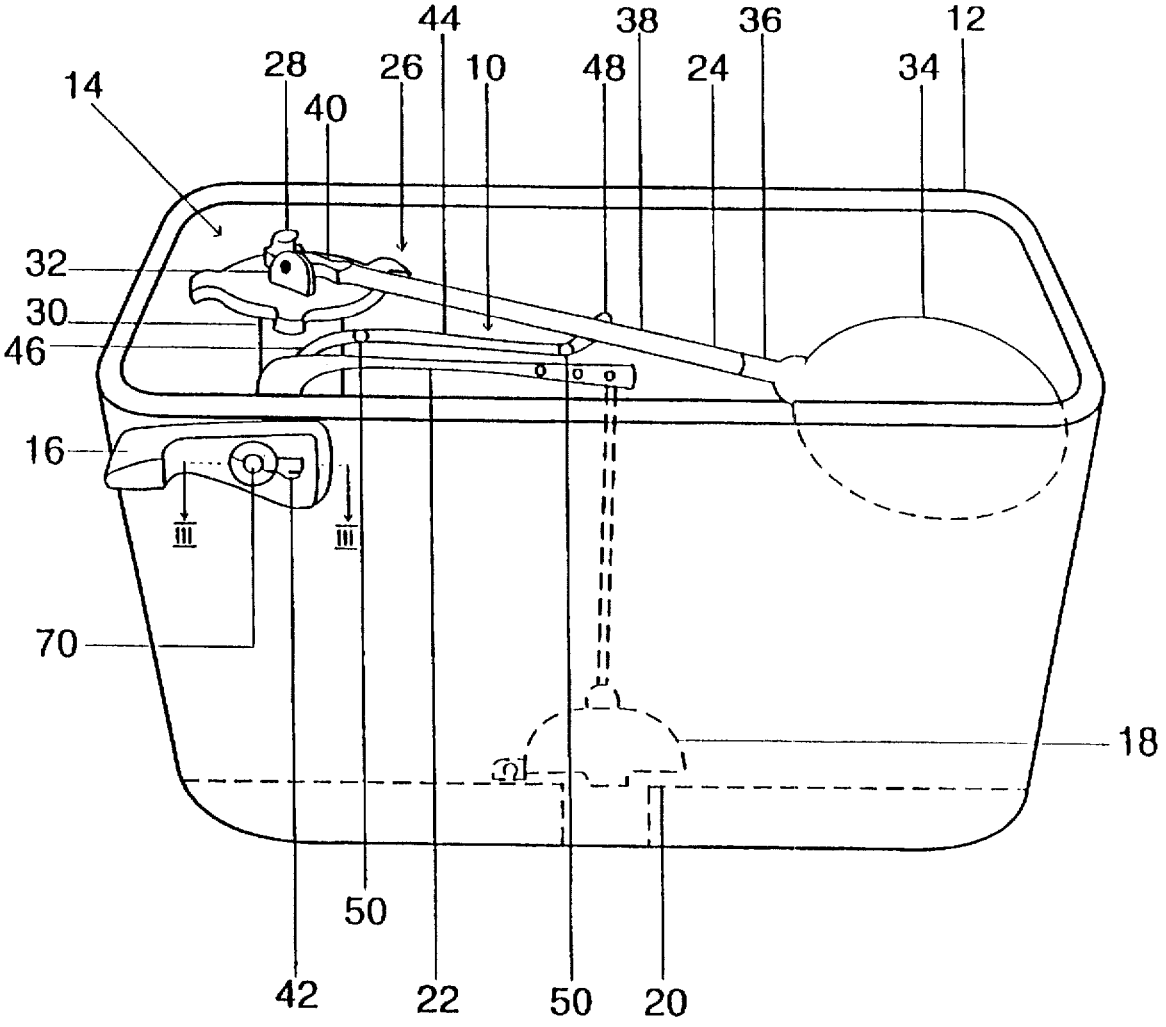
FIG. 1 is a perspective view of the present invention assembled within a toilet tank.

With reference to FIG. 1, an auxiliary shut-off device 10 for stopping the flow of water into a toilet tank 12 is disclosed. The auxiliary shut-off device 10 is incorporated into a conventional toilet tank control assembly 14. As stated previously, the flow of water into and out of the toilet tank 12 is controlled by the movement of a flush lever 16 that actuates a flapper valve 18 seated within a valve seat 20. The flush lever 16 is link to the flapper valve 18 by a flush arm 22. As a result, when the flush lever 16 is rotated counter-clockwise, the flapper valve 18 is moved from the valve seat 20. This permits water to flow from the toilet tank 12 and into the toilet bowl as the waste water is flushed from within the toilet bowl.

As the water flows from the toilet tank 12, the float valve 24 drops as it floats upon the surface of the water contained within the toilet tank 12. Movement of the float valve 24 downwardly actuates the float valve assembly 26, beginning the flow of water into the toilet tank 12. At the same time, the flapper valve 18 begins to move toward the valve seat 20 and seats in the valve seat 20 when the water level nears the bottom of the toilet tank 12. After the flapper valve 18 seats in the valve seat 20, the flow of water from the toilet tank 12 into the toilet bowl is stopped and the water flowing through the float valve assembly 26 begins to fill the toilet tank 12. As the water level within the toilet tank 12 rises, the float valve 24 floats on the surface of the water within the toilet tank 12 and continues to rise as the water fills the toilet tank 12. When the float valve 24 reaches its stop position at the top of the toilet tank 12, the float valve 24 contacts the stop valve 28 of the float valve assembly 26 to stop the flow of water to toilet tank 12 through the float valve assembly 26. The toilet is then ready for use.

For the purpose of this disclosure it should be understood that a conventional float valve assembly 26 includes an upwardly extending support post 30 through which water flows as the toilet tank 12 is filled. The float valve 24 is pivotally secured to the top of the support post 30 and is coupled to the support post 30 at pivot 32. The float valve 24 includes a float 34 positioned at the distal end 36 of a float arm 38. The proximal end 40 of the float arm 38 is secured to the pivot 32 such that the proximal end 40 of the float arm 38 contacts the stop valve 28 when the float 34 rises within the toilet tank 12. When the float valve 24 reaches its stop position, it actuates the stop valve 28 to stop the flow of water through the float valve assembly 26.

In accordance with the present invention, a shut-off device 10 is secured to the toilet tank 12 permitting movement of the float valve assembly 26 to be controlled in the event of a malfunction. This permits an individual to stop the flow of water to the toilet tank 12 when he or she desires. The shut-off device 10 includes a shut-off lever 42 positioned on the flush lever 16. The shut-off lever 42 is pivotally connected to the flush lever 16 to permit selective rotation of the shut-off lever 42. Alternatively, the shut-off lever 42 may be integrally formed with the flush lever 16. The shut-off lever 42 is rigidly connected to a control arm 44 extending within the toilet tank 12. While the proximal end 46 of the control arm 44 is rigidly secured to the shut-off lever 42, the control arm 44 is shaped to extend within the toilet tank 12 such that the distal end 48 of the control arm 44 is positioned directly beneath the float arm 38 of the float valve 24. As shown in FIG. 1, the distal end 48 of the control arm 44 is positioned at a location in the center of the float arm 38. It is believed that this position provides the leverage necessary for easily rotating the shut-off device to lift the float valve, although it should be understood that the control arm could be positioned at various locations along the float arm without departing from the spirit of the present invention. With this in mind, the control arm 44 is provided with a plurality of pivot points 50. The pivot points 50 permit the control arm 44 to be shaped for use with a wide variety of toilet tank control assemblies.

It should be understood that the float arm 38 has a limited range of movement when the toilet functions without the present shut-off device 10. As such, when the shut-off device 10 is not in use, the distal end 48 of the control arm 44 is positioned a sufficient distance below the float arm 38 so as not to interfere with the movement of the float arm 38 as it moves within the toilet tank 12. As will be explained in greater detail below, the control arm 44 moves from its non-use position beneath the float arm 38 to its use position supporting the float arm 38 when it is desired to stop the flow of water to the toilet tank 12.

Specifically, the arrangement of the shut-off lever 42 and the control arm 44 permits an individual to rotate the shut-off lever 42 and lift the float valve 24 when it is desirable to stop the flow of water through the float valve assembly 26 to the toilet tank 12. Specifically, the shut-off device 10 substantially replaces the water contained within the toilet tank 12 by lifting the float valve 24 such that it contacts the stop valve 28 to stop the flow of water through the float valve assembly 26 and into the toilet tank 12.

Figure 2:
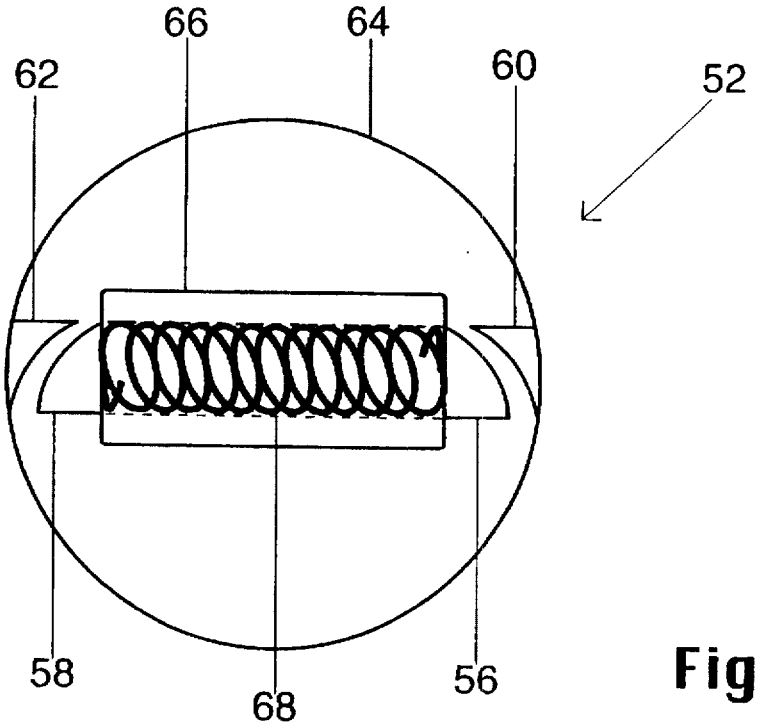
FIG. 2 is a cross-sectional view along the section II—II in FIG. 3.
Figure 3:
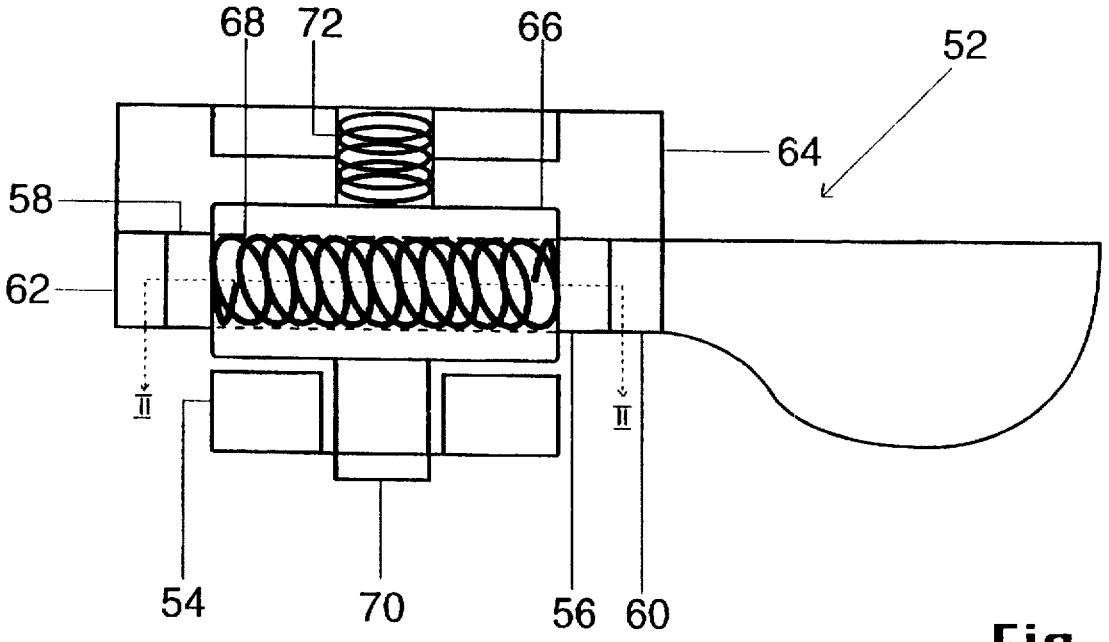
FIG. 3 is a cross-sectional view along the section III—III in FIG. 1.

Since it is often necessary to support the float valve 24 in its stop position (i.e., with the control arm 44 forcing it upward), the shut-off device 10 is provided with a releasable latch assembly 52. With reference to FIGS. 2 and 3, the shut-off lever 42 includes a stem 54 that passes though the flush lever 16. The stem 54 is secured to the proximal end 46 of the control arm 44 and includes opposed camming members 56, 58 which engage stops 60, 62 positioned within a stationary connector element 64 that supports the flush lever 16 and shut-off lever 42 on the outside of the toilet tank 12. The connector element 64 is substantially similar to those used with conventional flush levers, but has been modified to include stops 60, 62 along its internal wall. The camming members 56, 58 extend from within a recess 66 in the stem 54 of the shut-off lever 42 and are biased outwardly by a spring 68 positioned between the first camming member 56 and the second camming member 58. When the shut-off lever 42 is rotated counter-clockwise to force the control arm 44 to lift the float valve 24, the first camming member 56 moves past the first stop 60 until the shut-off lever 42 is held in a position supporting the float valve 24 in its stop position. Specifically, as the first camming member 56 moves past the first stop 60 it moves within the recess 66 against the force of the spring 68 and is biased outwardly to secure the shut-off lever 42 in position after the first camming member 56 moves past the first stop 60. The second camming member 58 and second stop 62 are provided in the event it is desirable to rotate the shut-off lever 42 in a clockwise direction when forcing the control arm 44 to engage and move the float valve 24.

After the shut-off lever 42 is rotated and securely held in position, the float valve 24 will remain supported until the button 70 on the shut-off lever is pushed against the force of a second spring 72 to axially move the recess 66 and camming members 56, 58 and respectively release them from stops 60, 62. Specifically, the recess 66 within the shut-off lever stem 54 permits the camming members 56, 58 to be moved axially such that the respective camming members move from the stops. Once the camming members are released, the shut-off lever 42 may be moved back to its starting position to permit the float valve 24 to function without the support of the shut-off device 10.

Figure 4:
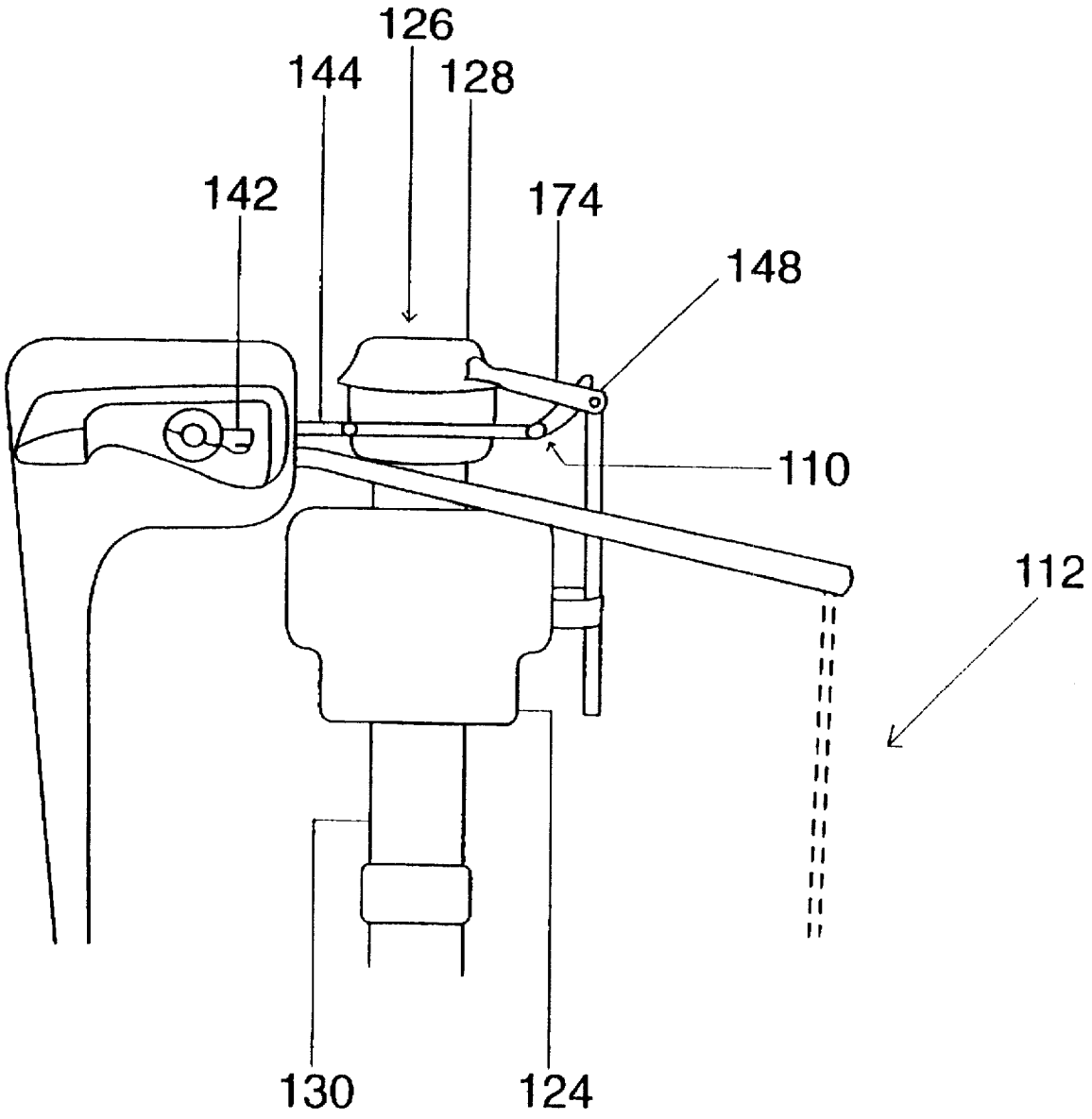
FIG. 4 is a perspective view of the present invention assembled within a alternate toilet tank.

As shown in FIG. 4, the shut-off device 110 may be adapted for use with a variety of the float valve assemblies. In contrast to the float valve assembly disclosed in FIG. 1, a float valve assembly 126 is disclosed with a support post 130 on which the float valve 124 is concentrically mounted to ride along the support post 130 as the toilet tank 112 fills with water. The float valve 124 is coupled to the stop valve 128 by a linkage arm 148, wherein the stop valve 128 includes a stop arm 174 extending from the top of the support post 130 such that the flow of water through the float valve assembly 126 is stopped when the stop arm 174 of the stop valve 128 is lifted by the movement of the float valve 124 within the toilet tank 112.

When the shut-off device 110 is utilized with float valve assemblies 126 of this type, the distal end 148 of the control arm 144 is shaped such that it may be positioned beneath the stop arm 174 of the stop valve 128. When the toilet malfunctions and it is desired to stop the flow of water within the toilet tank, the shut-off lever 142 is rotated in the same manner discussed above to move the stop arm 174 upwardly and stop the flow of water within the float valve assembly 126.

While the shut-off device is disclosed for use with two different float valve assemblies, the shut-off device may be adapted for use with a wide variety of float valve assemblies without departing from the spirit of the present invention. In addition, the shut-off device has been disclosed as a part of the complete toilet tank assembly, however, the shut-off device could be provided as a kit designed for retro-fitting to previously existing toilet tank assemblies. When retro-fitting a previously existing toilet tank assembly, the original flush lever is removed and the shut-off device is secured by attaching the flush lever and shut-off lever to the toilet tank such that the control arm is positioned beneath the stop arm or the float arm in the manner discussed above.

While the preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. An auxiliary shut-off device for stopping the flow of water into a toilet tank, wherein the toilet tank includes a float valve assembly having a float valve which rises within the toilet tank to control the flow of water into the toilet tank, comprising:

a lever arm adapted to be pivotally secured to the toilet tank through an opening in the toilet tank such that the lever arm is externally accessible;

a control arm having a proximal end directly secured to the lever arm and a distal end adapted to engaging the float valve assembly; and wherein rotation of the lever arm causes the float valve assembly to rotate to a stop position and stop the flow of water into the toilet tank.

2. The auxiliary shut-off device according to claim 1, wherein the shut-off device further includes a latch assembly for supporting the float valve assembly after the lever arm has been rotated to the stop position.

3. The auxiliary shut-off device according to claim 2, wherein the latch assembly includes a camming member which releasably engages a stop.

4. The auxiliary shut-off device according to claim 1, wherein the float valve includes a float and a float arm, and the control arm is adapted to engage the float arm such that rotation of the lever arm causes the float valve to rotate upwardly to the stop position and stop the flow of water through the float valve assembly.

5. The auxiliary shut-off device according to claim 4, wherein the shut-off device further includes a latch assembly for supporting the float and float arm after the lever arm has been rotated to the stop position.

6. The auxiliary shut-off device according to claim 5, wherein the latch assembly includes a camming member which releasably engages a stop.

7. The auxiliary shut-off device according to claim 1, wherein the float valve assembly includes a stop arm coupled to the float valve such that the stop arm is moved upwardly by the float valve to stop the flow of water through the float valve assembly when the stop arm reaches the stop position, and the control arm is adapted to engage the stop arm such that rotation of the lever arm causes the stop arm to rotate upwardly to the stop position and stop the flow of water through the float valve assembly.

8. The auxiliary shut-off device according to claim 7, wherein the shut-off device further includes a latch assembly for supporting the float valve and the stop arm after the lever arm has been rotated to the stop position.

9. The auxiliary shut-off device according to claim 8, wherein the latch assembly includes a camming member which releasably engages a stop.

10. The auxiliary shut-off device according to claim 1, wherein the lever arm is integrally formed with a flush lever.

11. A toilet tank including a shut-off device for stopping the flow of water into a toilet tank, wherein the toilet tank includes a float valve assembly having a float valve which rises within the toilet tank to control the flow of water into the toilet tank, wherein the improvement comprises:

the shut-off device mechanically coupled to the float valve assembly;

the shut-off device including a lever arm pivotally secured to the toilet tank through an opening in the toilet tank such that the lever arm is externally accessible and a control arm having a proximal end directly secured to the lever arm and a distal end engaging the float valve assembly; and wherein rotation of the lever arm causes the float valve assembly to rotate to a stop position and stop the flow of water into the toilet tank.

12. The toilet tank according to claim 11, wherein the shut-off device further includes a latch assembly for supporting the float valve assembly after the lever arm has been rotated to the stop position.

13. The toilet tank according to claim 12, wherein the latch assembly includes a camming member which releasably engages a stop.

14. The toilet tank according to claim 11, wherein the float valve includes a float and a float arm, and the control arm engages the float arm such that rotation of the lever arm causes the float valve to rotate upwardly to the stop position and stop the flow of water through the float valve assembly.

15. The toilet tank according to claim 14, wherein the shut-off device further includes a latch assembly for supporting the float and float arm after the lever arm has been rotated to the stop position.

16. The toilet tank according to claim 15, wherein the latch assembly includes a camming member which releasably engages a stop.

17. The toilet tank according to claim 11, wherein the float valve assembly includes a stop arm coupled to the float valve such that the stop arm is moved upwardly by the float valve to stop the flow of water through the float valve assembly when the stop arm reaches the stop position, and the control arm engages the stop arm such that rotation of the lever arm causes the stop arm to rotate upwardly to the stop position and stop the flow of water through the float valve assembly.

18. The toilet tank according to claim 17, wherein the shut-off device further includes a latch assembly for supporting the float valve and the stop arm after the lever arm has been rotated to the stop position.

19. The toilet tank according to claim 18, wherein the latch assembly includes a camming member which releasably engages a stop.

20. The toilet tank according to claim 19, wherein the lever arm is integrally formed with a flush lever.

* * * * *